United States Patent [19]

Wisner

[11] Patent Number: 5,054,307

[45] Date of Patent: Oct. 8, 1991

[54] UNIVERSAL BASE MEMBER FOR SECURING VEHICLES FOR DAMAGE REPAIR

[75] Inventor: Craig A. Wisner, Wauwatosa, Wis.

[73] Assignee: Hein-Werner Corporation, Waukesha, Wis.

[21] Appl. No.: 587,977

[22] Filed: Sep. 25, 1990

[51] Int. Cl.[5] ..... B21D 01/12

[52] U.S. Cl. ..... 72/457; 72/705

[58] Field of Search ..... 72/457, 422, 705

[56] References Cited

U.S. PATENT DOCUMENTS

| | | | |
|---|---|---|---|
| 4,337,636 | 7/1982 | Clausen | 72/705 |
| 4,520,649 | 6/1985 | Barton | 72/705 |
| 4,862,727 | 9/1989 | Bergeron | 72/705 |

*Primary Examiner*—Lowell A. Larson

*Attorney, Agent, or Firm*—Foley & Lardner

[57] ABSTRACT

An apparatus for securing vehicles to a rack, frame or bench, the apparatus including a universal base assembly for supporting various type attachment heads, the base assembly including a base which is adapted to be mounted on the rack and a slide mounted on the base for longitudinal movement relative thereto, the slide including a mounting plate for supporting the various types of attachment heads.

12 Claims, 5 Drawing Sheets

UNIVERSAL BASE MEMBER FOR SECURING VEHICLES FOR DAMAGE REPAIR

FIELD OF THE INVENTION

The present invention relates to an apparatus for securing vehicles to a frame straightening rack, bench or floor system and more particularly to an apparatus having a universal base assembly which is compatible with the various attachments which are required for each vehicle body design.

BACKGROUND OF THE INVENTION

The introduction of new automobile body styles and variations in manufacturing techniques has made it necessary to provide a specific set of attachment heads for each of the various body styles in order to properly secure a damaged vehicle to a frame straightening rack, bench or floor system. In order to repair a damaged vehicle, it is important for the vehicle to be securely mounted on a frame straightening rack so that the exact location of the data points on the vehicle can be measured and repaired. The conventional attachment system for securing a vehicle to the rack requires four double clamp type attachment devices each of which is attached to the pinch weld that runs along the bottom of the rocker panels on the vehicle. As the body styles have changed, the pinch weld has been shortened, relocated and in some instances eliminated, making it necessary to use a different attachment system for each vehicle style in order to hold the vehicle in a fixed position on the frame straightening rack.

Although the vertical pinch weld remains a standard point for clamping on many vehicles, horizontal pinch welds and in some instances pinch welds set at an angle of 35 degrees from the vertical are being used. Each configuration requires a different attachment system. The introduction of the jack mount by Mercedes requires a specific type of system for securing the vehicle to the rack. Suspension pockets are used on some of the General Motors vehicles which require another type of head. Since each vehicle must be anchored at four separate points, a repair shop must inventory at least one attachment system for each type of vehicle. This can be costly and requires considerable storage place for each attachment system.

SUMMARY OF THE INVENTION

The present invention advantageously provides an improved attachment apparatus for securing various types of damaged vehicles to a frame straightening rack. The system is designed to reduce the inventory of equipment required by a repair shop to accept any type of auto body for repair. The improved attachment apparatus is simple in construction and requires a minimum of effort for installation on any type auto body in a quick and easy manner.

In accordance with one aspect of the invention, the apparatus includes one set of four mounting assemblies, each assembly including a stand and a universal base assembly. Each base assembly includes a base and a slide having a mounting plate for supporting each of the various type attachment heads. In this regard, each attachment head, i.e. vertical, horizontal, angular or jack mount includes a plate which can be quickly and easily attached to the mounting plate on the slide. The base and slide are connected by a dovetail type mount which allows the slide to move with respect to the base for aligning the attachment head with the vehicle.

A primary advantage of the present invention is a reduction in inventory which the repair shop requires in order to service the various types of vehicles. One set of mounting assemblies is all that is required for each repair shop and one set of attachment heads for each type automobile.

In accordance with one aspect of the present invention, a simple and economical base assembly is provided which is compatible with each of the various attachment heads required for the various vehicles.

Other principal features and advantages of the invention will become apparent to those skilled in the art upon review of the following drawings, the detailed description and the appended claims.

DETAILED DESCRIPTION OF THE DRAWINGS

Figure 1:
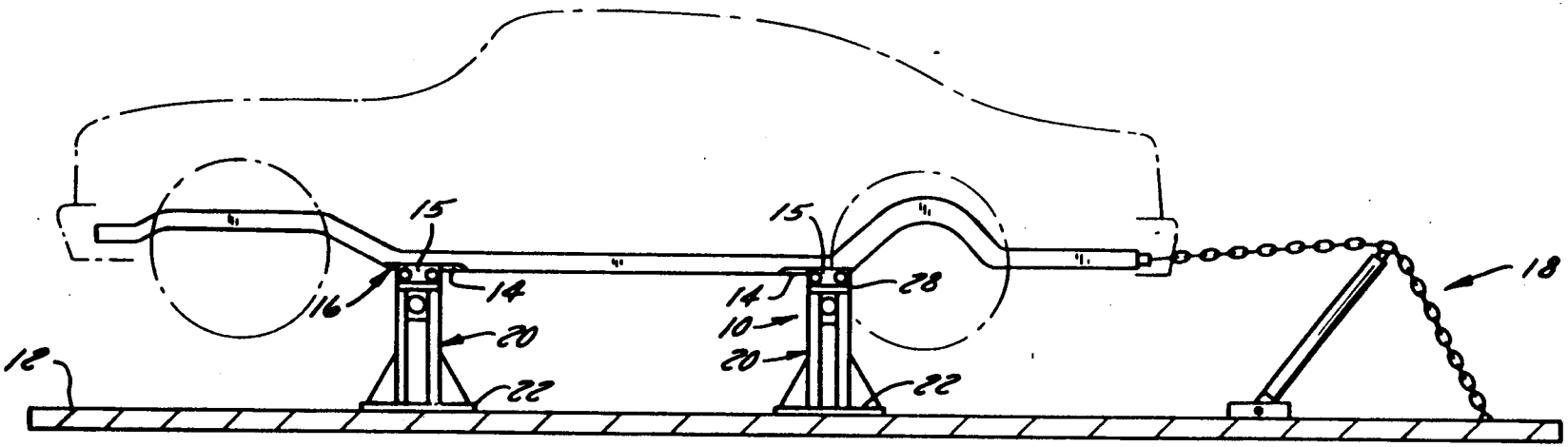
FIG. 1 is a side elevation view of an automobile secured to a repair frame by the attachment system of the present invention.
Figure 8:
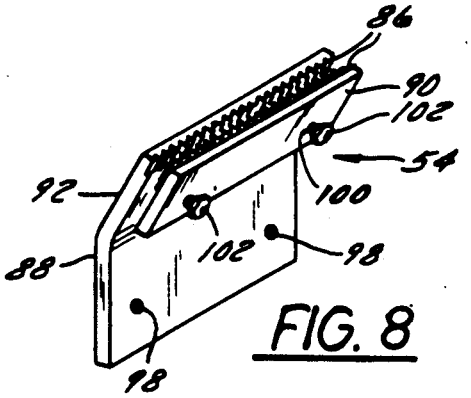
FIG. 8 is a view of an offset angle 35 degree pinch type head.

Although only one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EXEMPLARY EMBODIMENTS

As seen in FIG. 1, the attachment system includes a number of mounting assemblies 10 shown mounted on a rack 12 and connected to a pinch weld 14 on one side of an automobile generally shown at 16 by means of an attachment head 10. Four mounting assemblies 15 are required to securely anchor the automobile to the rack 12. A chain straightener assembly 18 is shown mounted on one end of rack 12.

The mounting assembly 10 includes a mounting stand 20 and a universal base assembly 28. It should be noted that the stand 20 includes a base plate 22 which can be secured to various places on the rack 12 by clamps (not shown) to thereby accommodate various types of body styles. A column 21 is secured to the top of the base plate 22 and includes a sleeve 24 mounted in a generally parallel relation to the rack. A pair of anti-rotational tabs 26 are provided on the end of sleeve 24.

The universal base assembly 28 is mounted on the sleeve 24 for securing the various attachment heads to a vehicle. The base assembly 28 includes a base 29 and a slide 50. The base 29 includes a plate 30 having a pair of angle members 32 mounted on each side of the top of the plate 30, forming a dovetail slot 33. A bracket 34 having a cylindrical opening 35 is secured to the bottom of the plate 30. A cylinder 36 is mounted in the opening 35. Means are provided for aligning the cylinder 36 in sleeve 24. Such means is in the form of notches 38 provided on each side of the cylinder 36.

The base 29 is secured to the column 21 by means of a tube 40 having a head 42 at one end and a slot 44 in the other end. A pin 46 is provided at the end of slot 44. The tube 40 is inserted into the opening 35 in bracket 34 and into the sleeve 24. A wedge 48 is inserted into the slot 44 between the pin 46 and the column 21 to draw the notches 38 in cylinder 36 into engagement with tabs 26 on the end of sleeve 24.

The slide 50 generally includes a plate 68 for supporting one of the various attachment devices, i.e., vertical 52, offset angle 54, horizontal (not shown) and jack mount 58. The slide 50 includes a slide plate 60 having an angular recess o each side which forms a dovetail slide 64 that matingly engages the dovetail slot 33 in plate 30. It should be noted that the slide 50 is moveable with respect to the plate 30 and is locked to the plate 30 by means of a screw 66 provided on the slide 50. This allows for a small amount of lateral movement to properly align the attachment head with the vehicle. The screw 66 is seated on one of the dovetail members 32 when properly aligned.

The attachment heads are secured to a plate 68 which is vertically mounted on the top of the slide plate 60. The attachment heads are secured to a plate 68 which is reinforced by a fillet 70. A pair of through holes 72 are provided in plate 68. One of the various attachment heads 15 are secured to the plate 68 by means of bolts 77 depending on the type of body style.

Figure 2:
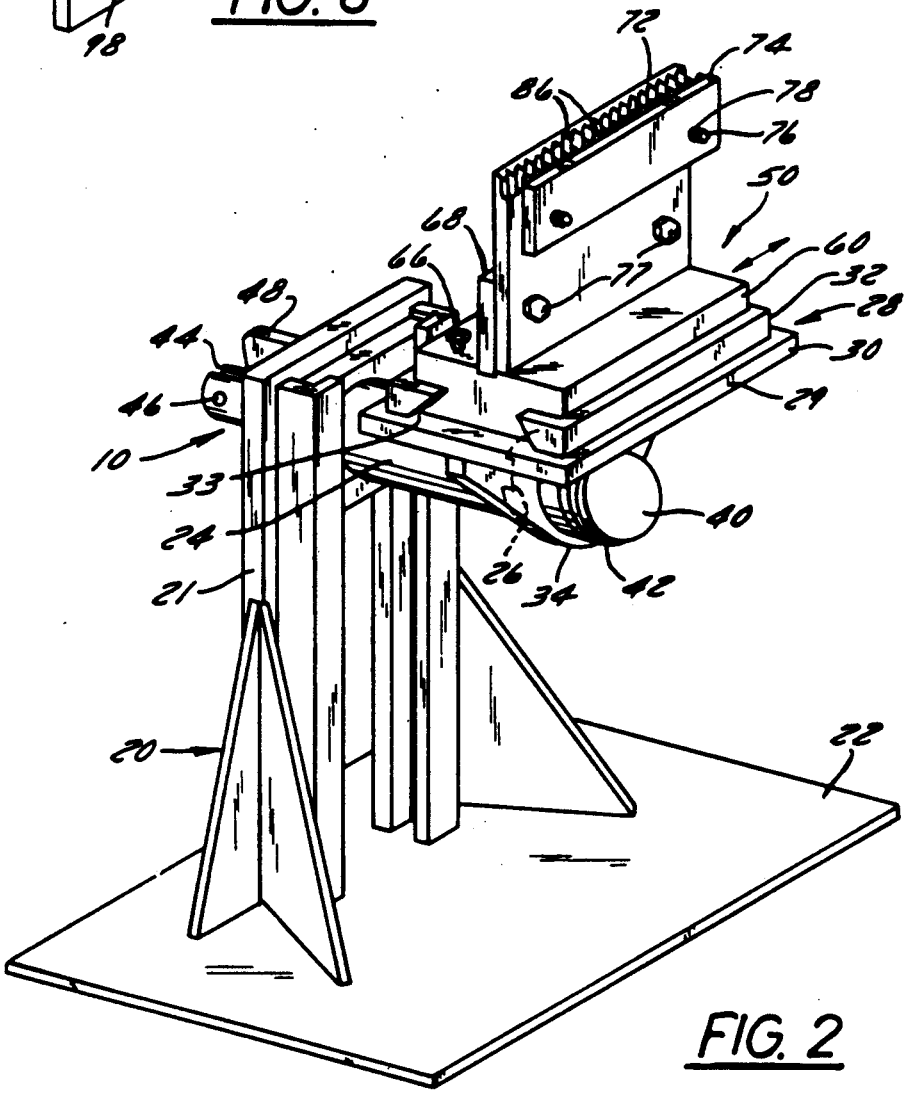
FIG. 2 is a perspective view of one of the mounting assemblies according to the present invention.
Figure 3:
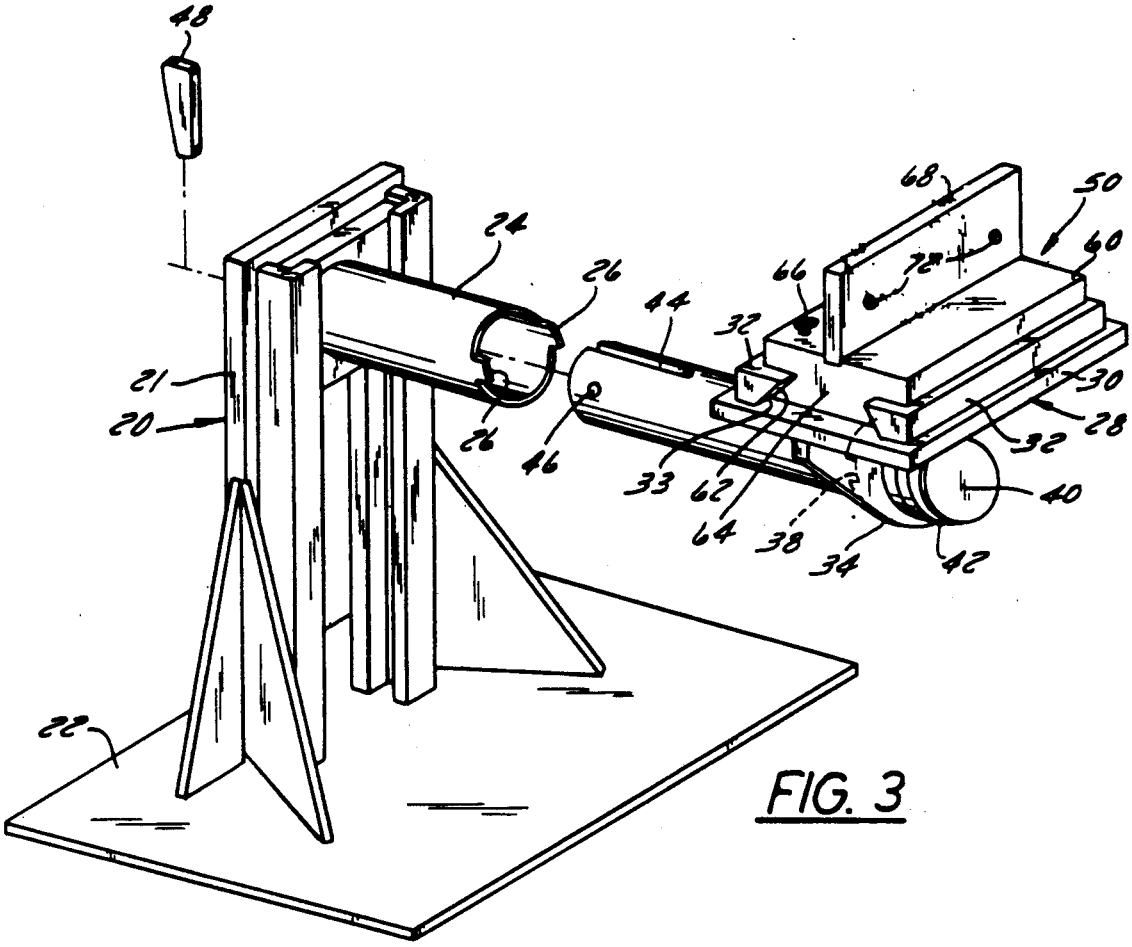
FIG. 3 is an exploded perspective view of the mounting assembly showing the universal base assembly and the mounting stand.
Figure 5:
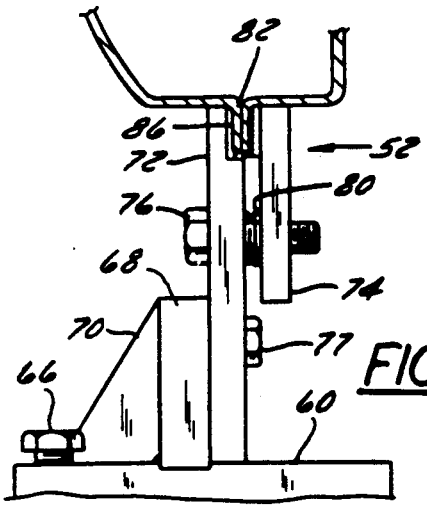
FIG. 5 is a view of the vertical head clamp mounted on the pinch weld.
Figure 4:
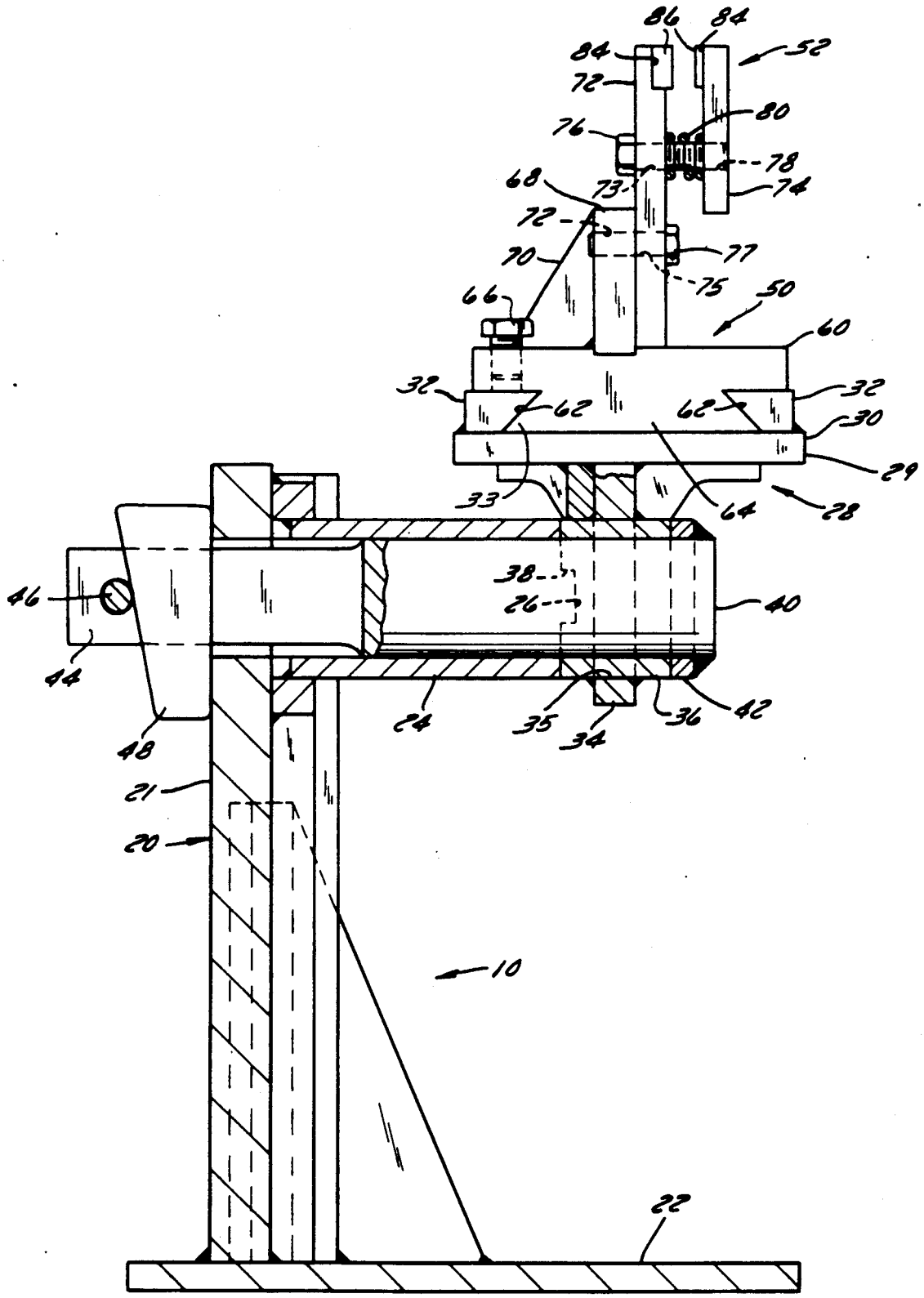
FIG. 4 is a cross-sectional elevation view of the assembly of FIG. 2 with a vertical pinch weld head clamp mounted thereon.

In this regard, the vertical attachment head 52 (FIGS. 2, 4, and 5) generally includes a base plate 72 and a clamp plate 74. The base plate 72 includes two pairs of holes 73 and 75. The clamp plate 74 includes a pair of threaded holes 78. The clamp plate 74 is mounted on the base plate 72 by means of a pair of bolts 76 which pass through holes 73 and are threadedly received in threaded holes 78. A spring 80 may be provided on bolt 76 between plates 72 and 74 to bias the plates to an open position. Means are provided between the plates to engage a pinch weld 82 as shown in FIG. 5. Such means is in the form of a serrated strip 86 mounted in a groove 84 in each plate 72, 74. The plates 72 and 74 are closed with sufficient force to seat the serrated strips 86 firmly on the pinch weld. The base plate 72 is secured to the plate 68 by bolts 77.

Figure 6:
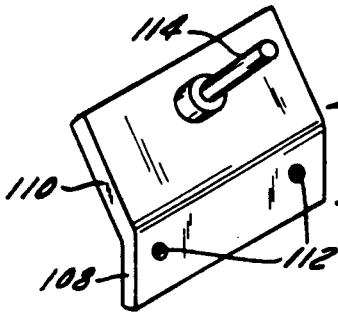
FIG. 6 is a perspective view of a jack mount type attachment head.
Figure 10:
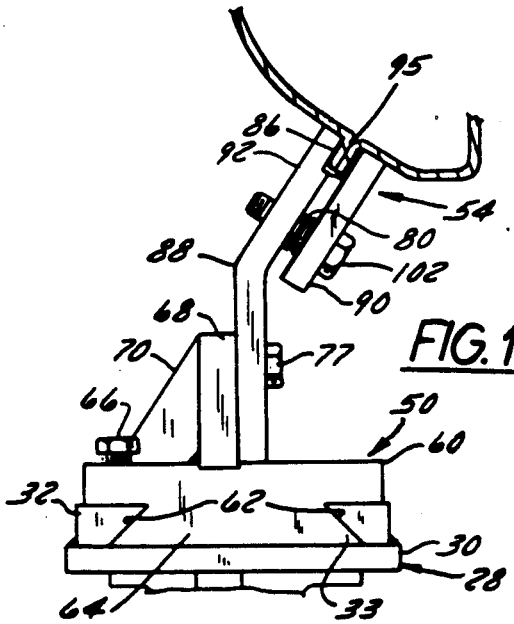
FIG. 10 is a view of the 35 degree head shown mounted on the pinch weld.
Figure 9:
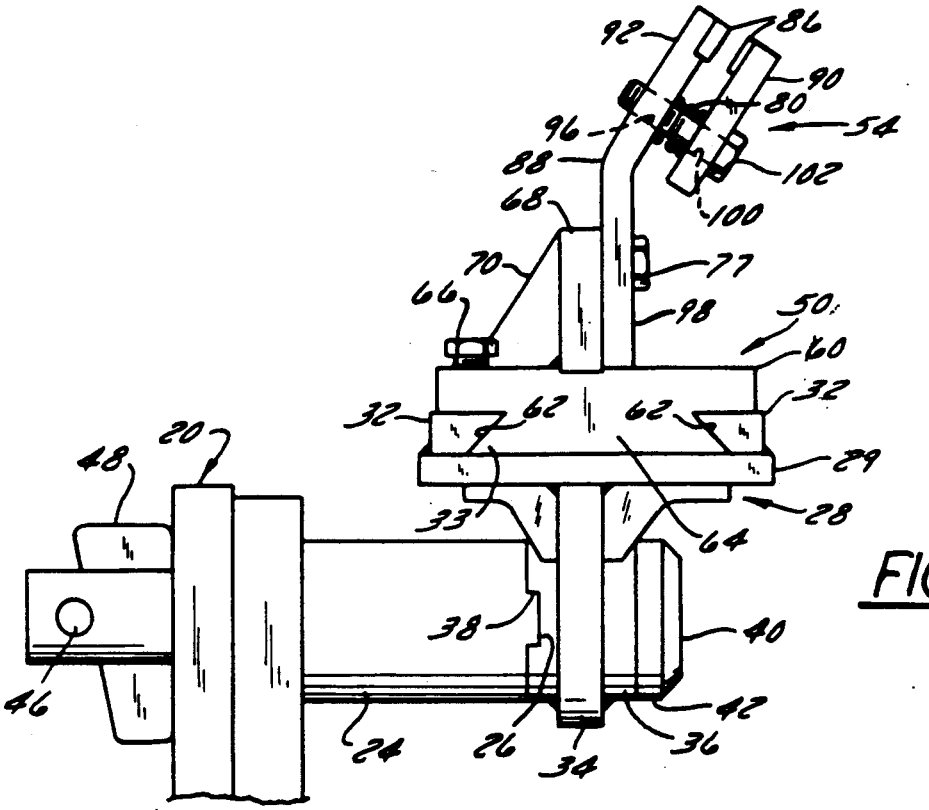
FIG. 9 is a perspective view of the 35 degree pinch type head.

The offset angle attachment head 54 (FIGS. 6, 9, and 10) generally includes a base plate 88 and a clamp plate 90. The base plate 88 includes an angularly offset portion 92 which corresponds to the angle of the pinch weld 95 (35°), a pair of threaded holes 96 and a pair of mounting holes 98. The clamp plate 90 includes a pair of holes 100 and is secured to the offset portion 92 by bolts 102.

Figure 7:
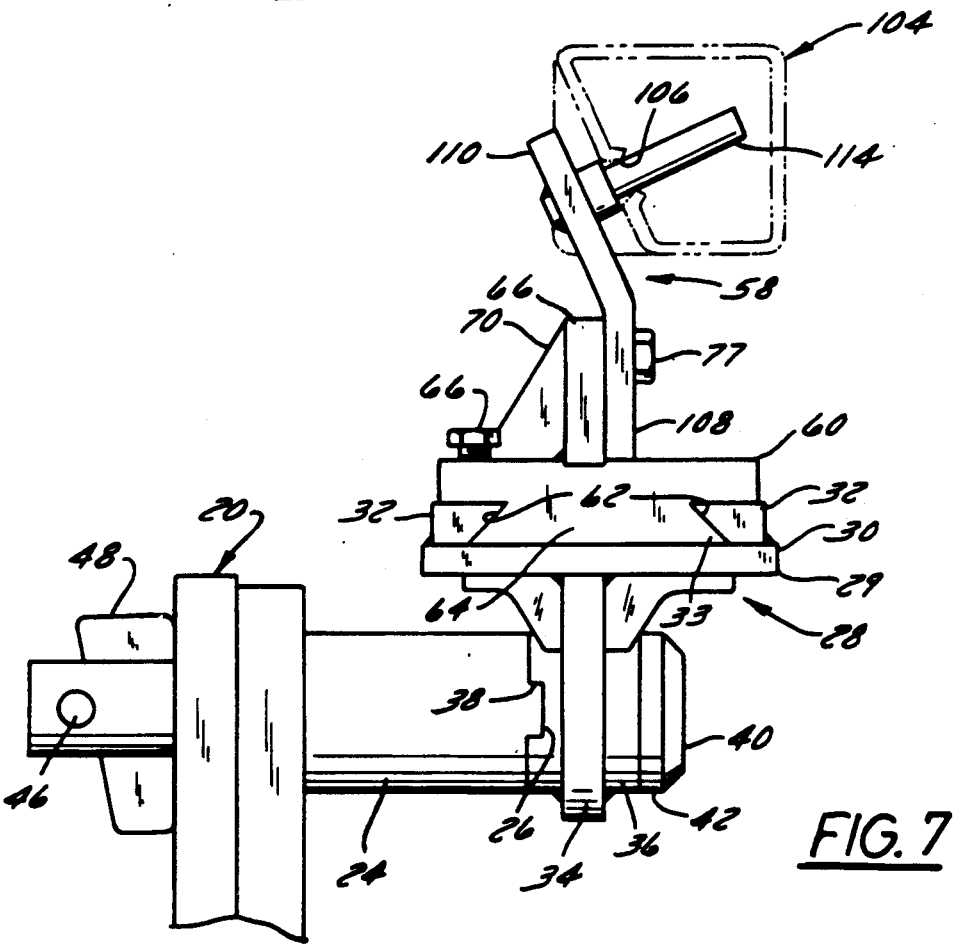
FIG. 7 is a view of the jack mount attachment head shown mounted on the universal base assembly.

The jack mount attachment head 58 (FIGS. 6 and 7) is used on vehicles having built-in jack mount type fixtures 104 permanently mounted on the vehicle. Each fixture 104 includes a mounting hole 106 on the side of the vehicle. The jack mount attachment 58 includes a base plate 108 having an angularly offset portion 110 and a pair of mounting holes 112. A locating pin 114 is provided in the offset portion 110 for engaging the hole 106 in fixture 104.

Thus, it should be apparent that there has been provided in accordance with the present invention a universal base member for securing vehicles for damage repair that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An assembly for securing a vehicle to a rack, said assembly comprising:

a universal base assembly, a stand for supporting said base assembly on the rack, said universal base assembly including a base mounted on said stand and a slide mounted on said base for sliding movement relative to said base, and a number of attachment heads adapted to be mounted on said slide for securing different vehicles to the rack, each attachment head including means for securing said attachment head to the vehicles at a predetermined position relative to the rack, and means for locking said slide to said base to locate said head relative to the vehicles.

2. The assembly according to claim 1 wherein said stand includes a mounting plate and a vertical column, said column including means for supporting said base in a fixed position relative to the rack.

3. The assembly according to claim 2 wherein supporting means comprises a sleeve mounted on said column, a cylinder mounted on said base and a tube mounted in said cylinder and said sleeve whereby said sleeve and cylinder are in axial alignment.

4. The assembly according to claims 1, 2, or 3 wherein said attachment head includes a pair of plates mounted in a parallel spaced relation for engaging a vertical pinch weld on the vehicle.

5. The assembly according to claims 1, 2, or 3 wherein said attachment head includes a pair of plates mounted in a parallel spaced relation for engaging a horizontal pinch weld.

6. The assembly according to claims 1, 2, or 3 wherein said attachment head includes a plate having an angularly offset portion and a pin mounted on said offset portion for engaging the vehicle.

7. The assembly according to claims 1, 2, or 3 wherein said attachment head includes a pair of plates mounted in an angularly offset relation for engaging an angularly offset pinch weld.

8. In a vehicle repair system wherein a damaged vehicle is to be secured to a rack, the improvement comprising:

a stand including a mounting plate adapted to be selectively mounted on the rack, a column secured to said plate and extending upwardly therefrom, a sleeve member mounted on the upper end of said column, a universal base assembly including a base having a dovetail slot mounted on said sleeve member and a slide having a dovetail configuration corresponding to said slot for selectively moving said slide in said base, said slide supporting one of a number of attachment devices in a predetermined position relative to the vehicle, and means for securing said base assembly to said sleeve member.

9. The system according to claim 8 wherein said securing means comprises a tube operatively connected to said base assembly and coaxially aligned with said sleeve member.

10. The system according to claim 8 wherein said slide includes a plate mounted on the slide in a vertical relation to the slide.

11. The system according to claim 10 wherein said attachment devices are secured to said vertical plate.

12. The system according to claim 11 wherein said attachment device includes a pair of plates mounted in a parallel spaced relation for engaging a pinch weld on the vehicle.

* * * * *